United States Patent [19]

Dahowski

[11] Patent Number: 4,735,395

[45] Date of Patent: Apr. 5, 1988

[54] INTERFACIAL SEPARATOR FOR CONCRETE STRUCTURES

[75] Inventor: Donald E. Dahowski, York, Pa.

[73] Assignee: Quaker Plastic Corporation, Mountville, Pa.

[21] Appl. No.: 833,294

[22] Filed: Feb. 25, 1986

[51] Int. Cl.[4] ..... E04G 9/00; E04B 1/66

[52] U.S. Cl. ..... 249/10; 52/169.14; 52/396; 52/573; 249/19; 249/84; 249/91; 249/DIG. 3; 249/219.1

[58] Field of Search ..... 249/9, 19, 26, 115, 249/84, 91, 219 R, DIG. 3; 52/396, 573, 63, 222, 202, 169.14; 160/399, 401, 402, 403, 392, 395, 383; 24/460, 462; 4/506

[56] References Cited

U.S. PATENT DOCUMENTS

| | | | |
|---|---|---|---|
| 2,261,602 | 11/1941 | Yeoman | 52/396 |
| 2,368,650 | 2/1945 | Fischer | 94/18 |
| 2,526,912 | 10/1950 | Swanson | 160/399 |
| 2,937,065 | 5/1960 | Harza | 72/106 |
| 3,058,518 | 10/1962 | Housman | 160/402 |
| 3,103,083 | 10/1963 | Seeger | 52/63 |
| 3,124,905 | 3/1964 | Stier | 50/100 |
| 3,292,330 | 12/1966 | Tennison | 52/403 |
| 3,348,801 | 10/1967 | Deason | 249/19 |
| 3,456,408 | 7/1969 | Zahn | 52/208 |
| 3,515,779 | 6/1970 | Jones | 261/41 |
| 3,526,070 | 9/1970 | Deason | 52/169 |
| 3,605,357 | 9/1971 | Stegmeier | 52/98 |
| 3,828,504 | 8/1974 | Egerborg et al. | 52/396 |
| 3,850,403 | 11/1974 | Stegmeier | 249/27 |
| 3,929,944 | 12/1975 | Oliver | 249/DIG. 3 |
| 3,967,422 | 7/1976 | Stegmeier | 52/169 |
| 3,987,997 | 10/1976 | Stegmeier | 249/207 |
| 4,063,839 | 12/1977 | Brown | 52/396 |
| 4,318,254 | 5/1982 | Stegmeier | 52/169 |
| 4,387,877 | 6/1983 | Deason | 249/9 |
| 4,528,783 | 7/1985 | Muir | 52/573 |
| 4,586,301 | 5/1986 | Hickman | 52/222 |

FOREIGN PATENT DOCUMENTS

| | | | |
|---|---|---|---|
| 2208822 | 10/1973 | Fed. Rep. of Germany | 24/462 |
| 847512 | 9/1960 | United Kingdom | 24/462 |

*Primary Examiner*—Jay H. Woo
*Assistant Examiner*—James C. Housel
*Attorney, Agent, or Firm*—Arthur J. Plantamura

[57] ABSTRACT

An improved system is provided for separation of contiguous concrete portions of a structure. This separation is advantageous in reducing structural failure caused by earth settlement, frost upheaval or excessive underground water pressure by allowing each section of an in-ground concrete structure affected to freely float independent of each other, thereby eliminating the effects of stress on the structure. The system has particular utility in forming a deck surrounding a swimming pool and may be used in conjunction with a form which is temporarily secured near the top on the vertical pool wall to receive the concrete forming the pool. The separator system is used at the interface at the top (on the bond beam) of the pool wall and under the deck and comprises an adapter and clip fastener. Once the separator adaptor is secured in place, a plastic film is placed thereon and securely fastened in place by snapping on a fastener clip which cooperates with the separator and adaptor and holds the plastic film or other web material in place over the substrate area which the concrete deck covers. The system performs also the function of a water stop between the pool wall and bond beam. Concrete is placed on top of the film covering the bond beam and acts as a separator eliminating the bonding together of the concrete deck and bond beam, thus permitting free movement of either member precluding damage from influences such as frost upehaval, earth settlement, underground water pressures, etc. thus minimizing structural failures.

7 Claims, 2 Drawing Sheets

INTERFACIAL SEPARATOR FOR CONCRETE STRUCTURES

The invention relates to an improved means for effecting separation between contiguous parts of concrete structures to minimize potential structural failure caused by disproportionate shifting between the respective parts such as may be caused by earth settlement, frost upheaval, excessive underground water pressure, and the like. In occurrences of this kind, it is desirable to have the contiguous parts, such as a concrete deck supported on a concrete wall, formed so as to be non-integral, i.e. so as to have one part "float" with respect to the other, to avoid structural damage.

BACKGROUND OF THE INVENTION

Poured concrete structural parts, for example a vertical swimming pool wall, with a surrounding deck superimposed on the wall, are typically constructed so as to be substantially integral. In structures of this and of similar concrete construction, where one part connects to another part, it would be advantageous to prevent structural damage to have an arrangement which permits (allows) the respective parts such as a swimming pool wall bond beam (top portion of wall) to be non-integral with its surrounding concrete deck. This separation can be advantageous in reducing structural failure caused by relative movement, e.g., earth settlement, frost upheaval or excessive underground water pressure, by allowing each section affected to freely float independent of each other. Such a "built-in" ability of one part to move, relative to its contiguous part, obviates the damaging stresses resulting from opposite forces as would be the case in a deck upheaval caused by ground frost, should deck and pool wall parts be integrally formed. It is thus apparent that a need exists for an improvement in structures of this kind where one part is to be placed on another part (such as a deck on a bond beam) in such a manner as to eliminate the bonding (adhesions) between the two, thus allowing both entities to freely move without being structurally integrated and subject to damage when stressed.

SUMMARY OF THE INVENTION

It is an object of the invention to provide a separator system between concrete parts to permit the respective parts to float with ground action. It is a more particular object of the invention to provide a joinder system for contiguous segments or parts of a concrete structure which is simple and expeditious to use and which will allow the contiguous parts to float under stress and avoid cracks or failure in the concrete that would otherwise result. Illustrative of such structures is a concrete deck or slab placed on a pool wall bond beam eliminating the bonding (adhesions) between the two, thus allowing both entities to freely move without being structurally integrated.

It is a more specific object of the invention to provide a swimming pool wall and deck construction which employs an adaptor and clip fastener that rests upon the pool bond beam, and may function as a water stop between the pool wall and the deck. When the separator adaptor is secured in place, web material such as a a plastic film is placed over the separator adaptor extending fully over the bond beam to provide a complete uninterrupted interface between the wall bond beam and the deck thereon. The web or film sheeting is securely fastened in place by snapping a fastener clip over an appendage of the separator adaptor provided for this purpose. This separator adaptor may be devised to function also as a water stop between the front of the pool wall and the bond beam. Concrete is then placed on top of the film which covers the bond beam, and which acts as a separator, eliminating the bonding together of the concrete deck and bond beam. This permits free movement of either member should stressful outside forces prevail, e.g. frost upheaval, earth settlement, underground water pressures, minimizing the likelihood of structural failures.

Additional objects and advantages will be apparent from the detailed description provided hereinbelow in conjunction with the several views of the accompanying drawing.

DETAILED DESCRIPTION OF THE PREFERRED EMBODIMENT

The invention may be applied in any concrete structure where one concrete part joins another concrete part to form a combined structure and where it is desirable to provide an interfacial separation between the parts.

Although the invention may be thus broadly applicable to permit an interfacial separation at the point joining two concrete portions, as will be apparent hereinafter, the invention will be described primarily in conjunction with the in-ground type swimming pools which have vertical peripheral walls formed of gunite or concrete. As used herein, the term "bond beam" refers to that portion at the top of a vertical wall having an enlarged width (affording enhanced support) upon which the concrete deck formed thereon is supported.

Figure 1:
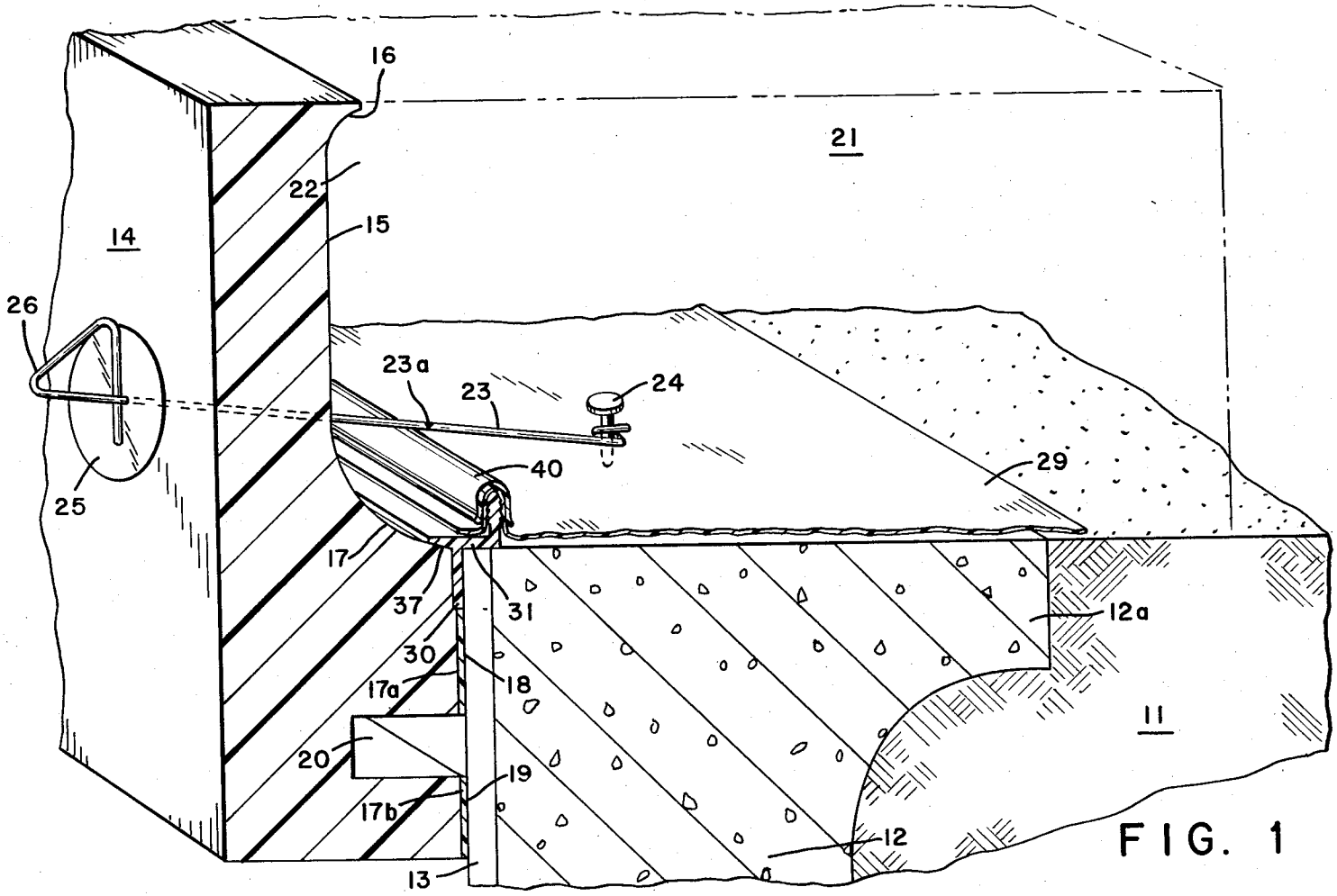
FIG. 1 is a fragmentary vertical sectional view showing an upper portion of a side wall of a swimming pool with a deck including coping, and a form, against which concrete is poured, together with the bond beam separator system of the invention in position relative thereto.

Referring to FIG. 1, a typical application of the invention in the construction of a swimming pool is described to illustrate the use of invention in greater detail. In the construction sequence, once the excavation in the ground 11, in which the swimming pool is to be positioned, is prepared, a swimming pool 12 of desired wall thickness is formed in a conventional manner such as by a gunite process or by pouring concrete against forms constructed for that purpose. The wall 12 is then suitably faced to present a finished, often aesthetically attractive, surface 13 at least at the upper interior portion of the pool wall (above and below water level) which is visible when the pool is filled. A band 13 of tiles of the desired width may be conveniently used for this purpose.

In preparing the deck and coping which is substantially horizontally disposed and formed peripherally around and at the top of the swimming pool wall 12, a form 14 is temporarily placed contiguous to the interior upper portion of the swimming pool wall to hold concrete which is poured against the form 14 until the concrete has set sufficiently. In FIG. 1 the concrete deck 21, superimposed on top of the bond beam portion of the wall 12 with a coping portion 11 which slightly overhangs the wall 12 inside the swimming pool is shown in phantom. The upper portion of the wall 12 is formed as is conventional with a wider top portion 12*a* and is referred to as a "bond beam".

Forms of the kind used to hold the concrete, such as that shown at 14, are known, and typically comprise a foam composition, e.g. expanded polystyrene composition and are shaped, at 15 and 16, to afford the desired coping configuration. Swimming pool deck and coping construction forms of this kind are described, for example, in U.S. Pat. Nos. 3,526,070, 3,967,422 and 3,987,997. Such forms are light in weight, relatively inexpensive and are devised for a single use and then discarded. Forms of this kind are provided in suitable discrete lengths or sections, such as eight-foot lengths, for example, and must be of sufficient rigidity and strength to hold, and resist movement from the weight of, the molten concrete which is poured against the form until the concrete has set and then be readily disengaged from the wall 12.

The form 14 is secured on the vertical surface near the top of the wall 12 at the interior of the wall 12 and as shown on the tile 13 and is formed with a surface which facilitates adherence to the tile 13 and includes an upper and lower securing surface 17*a* and 17*b*, respectively, with a relief portion 20 therebetween. As a means to secure the form and the wall, i.e. on the tile surface 13, strips 18 and 19 of a two-sided adhesive are applied on the upper and lower securing surfaces 17*a* and 17*b* of the form 14. The form 14 may be supplied with the adhesive strip having a peelable protective layer thereon which is removed to expose the adhesive surface when the form 14 is positioned on the wall. To aid in retention of the form 14 and to prevent premature movement or dislodgement of the form 14 before the concrete forming the deck and coping has sufficiently set, supplementary holding means comprising a tie wire 23 which is held against a washer 25 at one end and by a nail or pin 24 anchored on the wall 12. In this supplementary holding means, the tire wire 23 passes through an opening in the washer 25 and is provided with a twist or bend 26 so that pull through of the wire 23 is prevented by the bend 26 once pulled through the form 14, the free end of wire 13 is twisted around nail 24 to preclude the movement or displacement of the form 14 from its position on the face 13.

In joining the contiguous concrete elements, i.e. the deck 21 on the top of the bond beam portion of the wall 23, it is advantageous to have a separation between the respective elements to permit (allow) them to be non-integral and "float" freely so as to relieve stress that may occur between them. This separation between bond beam portion 12*a* of the wall 12 and the deck 21 formed thereon, can be important in reducing the likelihood of structural failure caused by various environmental influences such as, for example, earth settlement, frost upheaval or excessive underground water pressure, by allowing each section affected, i.e. the deck 21 or the wall 12, to freely "float" independent of each other, thereby eliminating opposite forces, as would be the case in a deck upheaval caused by ground frost should the deck 21 and the wall 12 be combined, i.e. bound as an integral unit.

It is thus seen that the invention provides a separator system which retains the separation between the "connecting" parts, i.e. the deck 21 and the bond beam of the wall 12 leaving each free float with ground action. The separator system allows the parts to be joined and yet retain a separation. In the case of a swimming pool, the concrete deck or slab is placed on the pool wall and a separation is maintained between the two at the point of support of the deck in a manner that precludes the bonding (adhesions) between the two, thereby allowing both entities to move freely without the hindrance of being structurally integrated; this interfacial separation substantially alleviates the possibility of structural damage.

Figure 2:
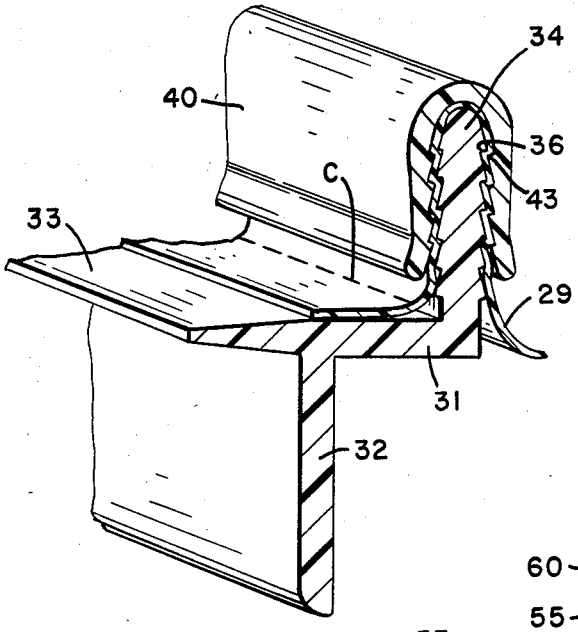
FIG. 2 is a perspective fragmentary view of the separator adaptor with a web material assembled in place thereon and with the securing clip locking the web in position.

The bond beam separator element of the invention which is positioned at the top of the bond beam portion of the wall 12 at the juncture with the superimposed deck 21, is illustrated in greater detail in FIG. 2. The system comprises: a separator element 30, whose configuration includes a horizontal portion 31, a depending segment 32 and an upending segment 34 (FIG. 3); a plastic webbing or sheet 29 which is positioned over the separator 30 and over the bond beam 12*a* at the top of the wall 12 and effectively forms a continuous separation at the interface. A retaining clip 40 which is contoured to have a generally downward facing U-configuration (see FIG. 4) and is positioned on the upending segment 34 of the adaptor 30, securing the web 29 therebetween, against dislocation.

By use of the bond beam separator system of the invention, a novel yet reliable easily installed and effective arrangement is provided to preclude the eventuality of damage to the concrete structure from upheaval, settling, and the like.

Figure 3:
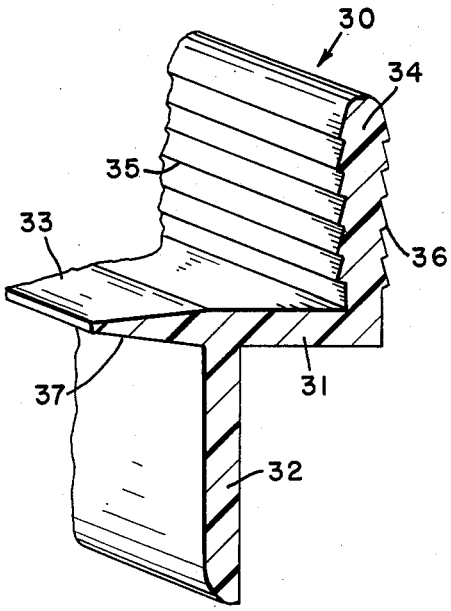
FIG. 3 is a perspective view of a fragment of a separator adaptor in accordance with the invention which functions as a retaining means and as a water stop.

The adaptor 30, as shown in detail in FIG. 3, is wedged between the top of the swimming pool wall bond beam 12*a*, the coping form 14 and the deck 21 (see FIG. 1) and is formed so as to conveniently accommodate its function as a water stop and as a retainer for web 29. The adaptor 30 has a horizontal portion 31 which rests on the top of the bond beam 12*a* (and tile 13); a depending portion 32 which abuts against the vertical face of tile 13; and a horizontal extension or abutting ledge 33 which rests on the bottom portion 17 of the cavity 15 of form 14.

As shown in its relationship in FIG. 1, the adaptor 30 provides an effective water stop seal to preclude concrete or moisture from flowing back, especially from seeping into the space between the wall 12 and tile 13. Moreover, when a plastic film is used as the interfacial separating layer 29, an unbroken seal extending from the front of tile 13 entirely across the wall bond beam is formed, effectively preventing seepage from the deck area to the wall portion below the web 29.

Installation of the adaptor 30 normally follows the positioning of the form 14. Thereafter, the web 29 is spread over the bond beam and onto the earth a sufficient distance to cover at least the substrate area over which the deck extends.

Figure 5:
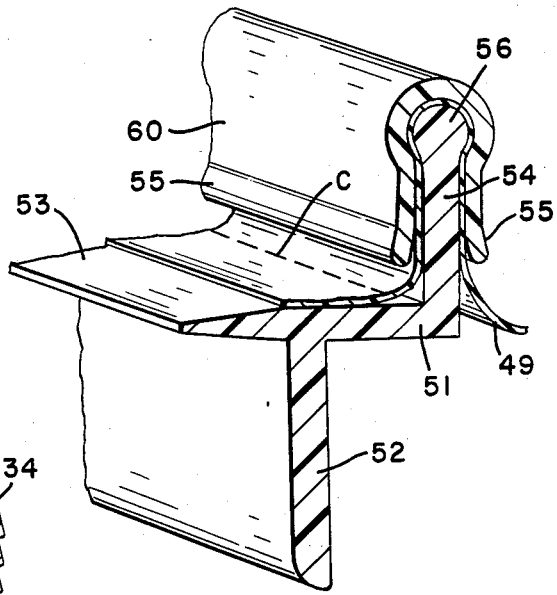
FIG. 5 is a perspective fragmentary view similar to that of FIG. 2 illustrating an alternate form of web securing adaptor.
Figure 6:
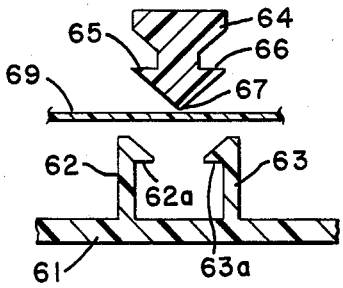
FIG. 6 is fragmentary sectional view of still another form of web securing adaptor.

The adaptor 30 may take a variety of shapes as illustrated by the alternate embodiments of FIGS. 1, 5 and 6, providing that it serves its function to retain the interfacial web 29 against dislocation.

Figure 4:
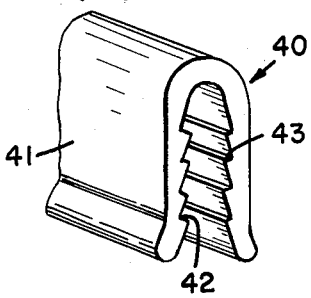
FIG. 4 is a perspective view of a mating securing clip used with the separator adaptor shown in FIG. 3.

In the embodiment illustrated in FIGS. 2–4, the "upending" or vertical upward extending segment 34 of the adaptor 30 is preferably provided with a knurled or serrated construction 35 and 36 which enhance the grip with the corresponding mating abutting surfaces 42 and 43 at the inside of the clip 40 (FIG. 4) which is positioned on the upending segment 34 of adaptor 30, locking therebetween the webbing 29, as best seen in FIG. 2. It will be apparent that while a plurality of serrations are shown formed on the outer surface of the adaptor upending portion 34 and on the interior of the clip 41, a single mating abutment or other means that suffices to hold the plastic film or other web 29 in position against displacement on the adaptor may be used.

The adapter 30 with an impermeable plastic film thus provides a complete water stop. Once the separator adaptor is secured in place, a web or film 29 is then placed over the upper upending appendage 34 (FIG. 2) or 54 (FIG. 5) of the separator adaptor extending back over the bond beam for a suitable distance preferably at least covering the substrate area which is to be covered by the deck. The web 29, preferably a plastic film, is securely fastened in place by snapping the fastener clip 40 (FIG. 4) over serrated appendate 34 of separator adaptor 30 as shown in FIG. 2.

Referring to the embodiment of FIG. 5, a web or film 49 is similarly secured as the embodiment described in FIG. 2 on an upending extension 54 which terminates in a knob-like cross section 56. The holding strip 60, having a U-shaped cross section, is then pressed down on the extension with sufficient pressure to overcome the resilient resistance of the element 60, i.e. until the arms 55 of element 60 are spread sufficiently to snugly position the retaining strip 60 on the element 54, with the web 49 securely retained against being displaced.

In the embodiment of FIG. 6, a form of retaining adaptor in which the construction of the parts of the adaptor are reversed is shown, i.e. the first part comprises a rail-like element having a base portion 61 and extensions 62 and 63 terminating in converging portions **62*a* and 63*a* which function to cooperate with extensions 65 and 66 respectively, of the holding element 64 which is shown as having an arrow-like configuration in cross sections. The web 69 is effectively retained by placing it over the element 61 and pressing the strip element 64 between arms 62 and 63 until the latter are spread (against resilient resistance) to receive the arrow head portion 67** between the two.

As noted hereinabove, an important secondary function of the adaptor when used in its bond beam embodiment to construct a peripheral deck for an in-ground swimming pool, is that of a water stop between the front of the swimming pool wall and the bond beam which prevents damage to the surface tile and/or the wall or deck of the pool arising from seepage.

The following general sequence, with reference to FIG. 1, is employed in the installation of a bond beam separation system of the present invention in relationship to the forming of the deck surrounding the pool. Once the pool is formed, whether of the concrete or gunite type or other below ground type, and the concrete for the deck is to be formed on the bond beam (widened) portion **12*a* at the top of the wall 12, the deck form 14 is positioned on the inner vertical face of the pool wall, near the top of the pool wall. The form 14 is adhered contiguous to the top of the wall by pressing the pressure sensitive adhesive portions 18 and 19 of the form 14 against the swimming pool wall facing 13. The adaptor 30 is then inserted, forming a water stop, between the vertical face of the wall 12 usually covered with tile 13. The webbing 29 is then draped over the adaptor 30 and bond beam part of the wall and extends sufficiently onto the contiguous ground at least covering the substrate area underlying the area to be covered by the poured concrete deck 21. The inverted U-shaped holding clip 40 is then pressed over the upending part 34 of the adaptor securely held web 29 between the respective parts of the adaptor as shown in detail in FIG. 2. Any excess portion of the web between the adaptor 30 and the form 14 may be easily removed if desired by running a utility knife in a direction shown by broken line C in FIG. 2. The supplementary retaining element for the form 14 comprising the wire 23 is then secured by passing the straight end of wire 25 through the opening in washer 25, in position against the back of form 14, perforating the form, drawing the wire through until the twisted end 26 is firmly against the washer 25 and twisting the end of the wire around nail 24**.

To facilitate removal of wire 23 which extends outside the poured concrete deck 21, the wire is conveniently notched at **23*a* to permit that portion of the wire by twisting it at 26 thereby rupturing it at 23*a***. This is preferably done while the poured concrete is still green, i.e. it has set but not cured.

It will be apparent that while a detailed description has been provided to present the best mode for utilizing the invention, various modifications apparent to one skilled in the art may be made in the details presented without departing from the scope or spirit of the invention.

What is claimed is:

1. An interfacial separator system for maintaining a separation web between the surface of a first concrete structural part and the surface of a second concrete structural part formed contiguous to said first part comprising in combination:

I. a removable form including anchoring means for positioning said form against and anchoring said form on, the first concrete part and against which the second concrete part is formed, and II. a separation web arrangement including A. a first retaining element adapted to be secured to the surface of a first concrete part adjacent said form and having interlocking means at an unsecured side to interlock with a second retaining element, B. a separation web adapted to be draped over said first concrete part and having a sufficient area to cover the area of separation to be maintained between the respective surface of the said first concrete part and a second concrete part abutting thereon, C. a second retaining element having interlocking means cooperating with the interlocking means of said first retaining elements and securing therebetween, to restrain the dislocation thereof, the separation web being positionable between the said surfaces of the said abutting concrete parts.

2. The separator system of claim 1 wherein the interlocking means of the first retaining elements comprises an upending finger and the interlocking means of the second retaining element comprises a U-shaped resilient member which when compressed over the upending finger is securely retained thereon.

3. The separator system of claim 2 wherein the upending finger is serrated or notched externally and said U-shaped clip is correspondingly serrated or notched internally.

4. A bond beam separator system for the interface between the top horizontal surface of a vertical wall of a swimming pool and a deck which overlies the vertical wall comprising in combination A. a longitudinal adaptor positioned at the top of a vertical swimming pool at the juncture of the inner face of the vertical wall and a deck overlying the wall and forming a water stop seal at said juncture, said adaptor including as integral segments thereof, a horizontal segment which abuts on a top horizontal surface of the wall and terminates in an abutting ledge portion at one end, a depending segment which abuts against the inner vertical face, and continguous to the top, of the pool wall and is formed intermediate said horizontal segment and the ledge portion thereof, and an upending segment on which a web, forming an interfacial layer between the horizontal top surface of the pool wall and the deck, is secured, B. a web overlying said adaptor and the top of the pool wall on which said adaptor is positioned, and C. a clip positioned on said web and on said upending segment of the adaptor and locking said web between said upending segment and said clip.

5. The system of claim 4 in combination with a removable form secured at an upper edge of the inner face of the pool wall and having a cavity against which concrete is poured to form the deck and wherein a supplementary anchoring means comprising a tie wire which passes substantially horizontally through the removable form and is anchored in the top horizontal surface of the wall at one end and secured to the back of the removable form at the other end.

6. The system of claim 5 wherein the deck form is constructed of a foamed synthetic resin composition.

7. The system of claim 5 wherein the deck form is formed from a foamed synthetic resin composition and the tie wire is held on the back of the form by a washer which contacts an end of the wire and against which the end of the wire is secured.

* * * * *